US007614350B2

(12) United States Patent
Tuttle et al.

(10) Patent No.: US 7,614,350 B2
(45) Date of Patent: Nov. 10, 2009

(54) WALL-MOUNTED SHELF UNIT

(75) Inventors: Robert L. Tuttle, Saugatuck, MI (US); Shawn Yu, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 481 days.

(21) Appl. No.: 11/543,422

(22) Filed: Oct. 5, 2006

(65) Prior Publication Data

US 2008/0083353 A1 Apr. 10, 2008

(51) Int. Cl.
*A47B 85/00* (2006.01)

(52) U.S. Cl. ..... 108/23; 108/50.02; 108/47

(58) Field of Classification Search ..... 108/23, 108/50.01, 50.02, 152, 108, 47, 48, 42; 362/125; 248/235; 312/223.1, 223.5, 223.6; 211/70.7, 211/70.6, 74

See application file for complete search history.

(56) References Cited

U.S. PATENT DOCUMENTS 3,669,035 A 6/1972 Grossman
4,037,896 A * 7/1977 Kennedy et al. ..... 108/47
4,228,905 A * 10/1980 Cammarota ..... 108/28
D270,766 S 9/1983 Gray
4,479,650 A * 10/1984 Neuhierl ..... 463/63
4,508,301 A 4/1985 Nicholson et al.
4,843,977 A * 7/1989 Bridges ..... 108/152
4,989,654 A * 2/1991 Berkeley ..... 144/286.5
5,116,011 A * 5/1992 Smith ..... 108/27
5,188,246 A * 2/1993 Maxworthy ..... 108/152
5,413,052 A * 5/1995 Breezer et al. ..... 108/57.25
5,626,084 A * 5/1997 Kelly et al. ..... 108/23
6,179,434 B1 * 1/2001 Saraiji ..... 108/23
6,467,632 B1 * 10/2002 Guillot ..... 108/152
6,571,498 B1 6/2003 Cyrluk
6,578,498 B1 6/2003 Draudt et al.
6,796,445 B2 9/2004 Cyrluk
7,300,122 B2 * 11/2007 Vardon ..... 108/108

FOREIGN PATENT DOCUMENTS

GB 2255820 A * 11/1992

* cited by examiner

*Primary Examiner*—José V Chen
(74) *Attorney, Agent, or Firm*—Flynn, Thiel, Boutell & Tanis, P.C.

(57) ABSTRACT

An elongate horizontally-oriented shelf unit which is preferably constructed as a monolithic one-piece member, and is provided with a groove which opens upwardly from a bottom surface thereof and which extends lengthwise of the shelf for accommodating a detachable electrical accessory at any location therealong for downward suspension from the shelf. The groove has a pair of low-voltage conductors embedded in the opposite side walls thereof to extend lengthwise of the groove, and accessible from the interior of the groove to provide electrical contact with an accessory which is inserted into the groove and moved into contact with the conductors. The conductors at one end of the groove, or at one end of a plurality of shelf units which are serially connected together, are joined to a suitable flexible electrical connector which joins to a conventional transformer plug for engagement with a conventional electrical outlet.

16 Claims, 9 Drawing Sheets

WALL-MOUNTED SHELF UNIT

FIELD OF THE INVENTION

This invention relates to a wall-mounted storage unit, particularly a horizontally-oriented shelf unit, and more specifically relates to improvements with respect to constructional and operational features of a shelf unit to permit increased flexibility and usability thereof.

BACKGROUND OF THE INVENTION

Horizontally-oriented shelves are extensively utilized in interiors, particularly offices, for supporting external loads such as books and other objects. Such shelves are typically secured to an upright wall and, in office environments wherein the walls are defined by prefabricated upright space-dividing wall panels, the shelves are frequently secured to the wall panels by rear brackets which have a series of hooks positioned for engagement within slotted uprights which typically define the edge frame of the wall panel. Such constructions are typically referred to as "modular" constructions since the shelf is restricted to lengths and locations dictated by the construction of the upright wall panels. In an effort to increase the flexibility with respect to length and location of the shelf, other constructions have been devised wherein the shelf is provided with top and bottom hooks or similar attachment brackets which in turn engage in elongated horizontal rails which are secured to the wall, thereby providing increased flexibility with respect to shelf length and shelf location.

While shelves of the aforementioned type have proven to operate reasonably successfully with respect to supporting external loads or objects thereon, the shelves have otherwise not proven to be readily adaptable with respect to providing additional functionality. While many of the shelves have permitted lights to be secured to the underside thereof, nevertheless the construction of the shelf has typically limited the type of light which can be utilized, as well as interfered with the overall appearance of the assembled shelf unit. Further, such shelves have not been readily adaptable with respect to permitting other types of objects to be secured thereto, particularly to the underside thereof, nor have such shelves been constructed in a manner which tends to increase their flexibility and adaptability of use, while minimizing their manufacturing costs.

Accordingly, it is an object of this invention to provide an improved construction for a storage unit and particularly a shelf unit which is adapted for mounting on an upright wall for permitting storage of external objects or loads thereon, and which provides increased functional cooperation and adaptability with respect to mounting of accessories on the shelf, particularly suspended from the underside thereof, while at the same time providing an economical shelf which can be produced in a wide variety of lengths and which has adaptability with respect to its mounting on a wall, thereby overcoming many of the disadvantages associated with known constructions.

More specifically, the present invention relates to an improved elongate horizontally-oriented shelf which is preferably constructed as a monolithic one-piece member, such as by being extruded of a formable material, such as a plastics material, and is provided with a groove which opens upwardly from the bottom surface thereof and which extends lengthwise of the shelf for accommodating a detachable electrical accessory at any location along the groove for downward suspension from the shelf. The groove has a pair of electrical conductors, such as low-voltage conductors, embedded in the opposite side walls thereof so as to extend lengthwise of the groove, and accessible from the interior of the groove to provide electrical contact with an accessory which is inserted into the groove and moved into contact with the conductors. The conductors at one end of the groove, or at one end of a plurality of shelf units which are serially connected together, are joined to a suitable flexible electrical connector which joins to a conventional transformer plug for engagement with a conventional electrical outlet.

The invention also relates to an improved shelf, as aforesaid, wherein the shelf is preferably provided with one or more secondary grooves formed in and opening upwardly from the bottom side thereof, and extending lengthwise of the shelf in generally parallel relationship to the electrical-accessory receiving groove. The secondary groove preferably has a cross-sectional configuration, such as an undercut, enables an upwardly protruding mounting bracket as associated with a suitable accessory such as a small suspended shelf unit, or the like, to be inserted into and engaged within the secondary groove so as to secure the accessory to the underside of the shelf so that the accessory is maintained in downwardly suspended relationship therefrom.

The invention also relates to an improved shelf which mounts, on the underside thereof, an improved light for illuminating the region under the shelf. The shelf is preferably constructed as a monolithic one-piece member, such as by being extruded of a formable material, and has a groove which opens upwardly from the underside of the shelf and extends horizontally throughout the length thereof. The groove is provided with appropriate undercuts, one of which mounts therein an elongate light board which can be slidably inserted into the groove and supported therein for disposition throughout the length of the shelf, and which mounts thereon appropriate lighting, such as a plurality of LEDs disposed in spaced relationship lengthwise along the light board. A suitable diffuser is also slidably inserted into and extends lengthwise along the groove at a location below the light board to provide effective downward diffusion of the light emitted from the LEDs. A flexible electrical supply connector is joined to one end of the light board, and the other end of the connector has a conventional transformer-plug associated therewith for engagement within a conventional electrical receptacle.

Other objects, purposes and features of the invention will be apparent to persons familiar with constructions of this general type upon reading the following specification and inspecting the accompanying drawings.

Figure 1:
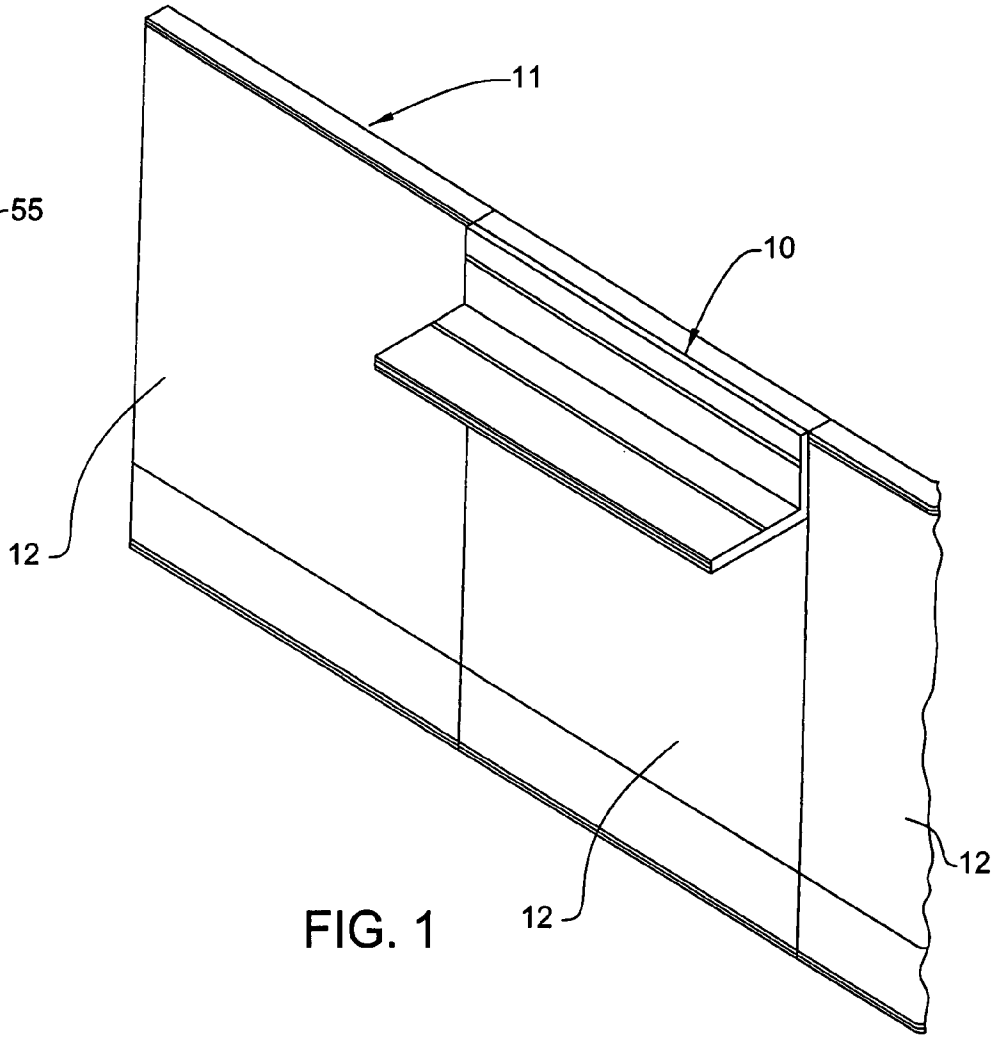
FIG. 1 is a perspective view showing a shelf unit according to the present invention as mounted on an upright wall.

Certain terminology will be used in the following description for convenience in reference only, and will not be limiting. For example, the words "upwardly", "downwardly", "rightwardly", and "leftwardly" will refer to directions in the drawings to which reference is made. The words "upwardly" and "downwardly" will also be used to refer to the normal positional orientation and use directions of the shelf unit according to the present invention. The words "inwardly" and "outwardly" will refer to directions toward and away from, respectively, the geometric center of the unit and designated parts thereof. Said terminology will include the words specifically mentioned, derivatives thereof, and words of similar import.

DETAILED DESCRIPTION

Figure 2:
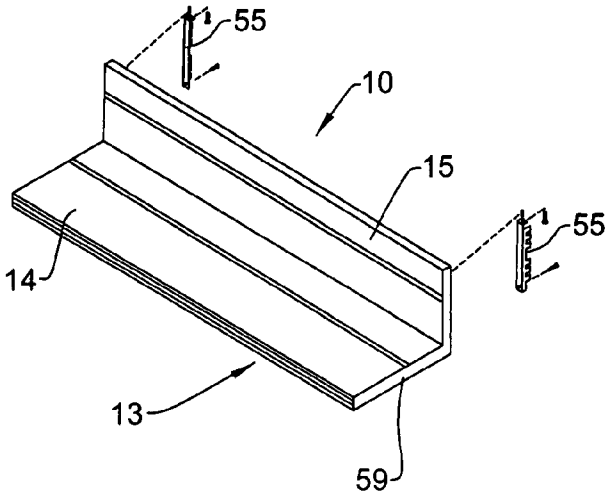
FIG. 2 is a perspective view of solely the shelf unit illustrated in FIG. 1.
Figures 3, 3A:
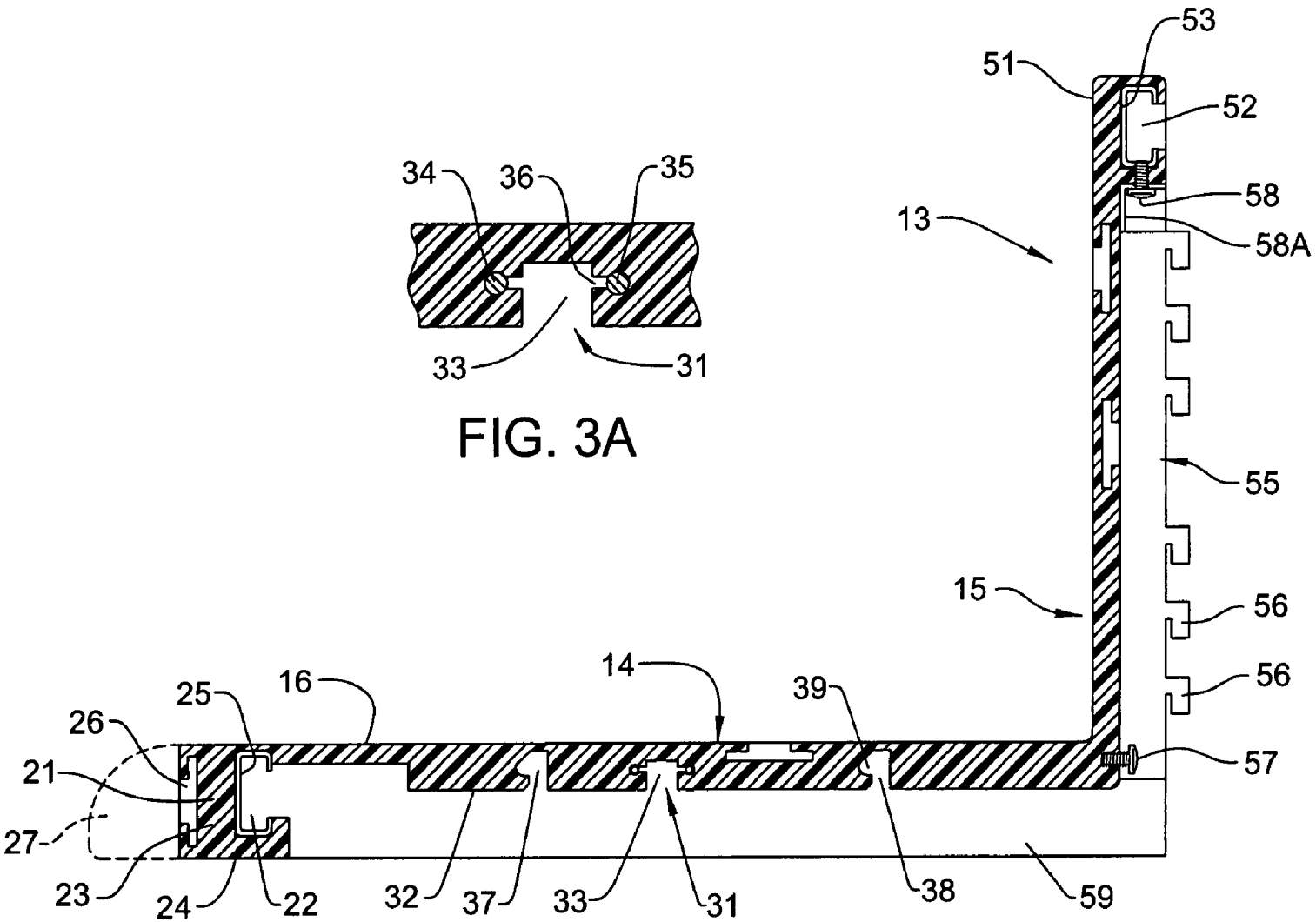
FIG. 3 is an enlarged elevational view showing, in cross-section, the construction of the improved shelf unit illustrated in FIG. 2.
FIG. 3A is a fragmentary enlargement of a portion of FIG. 3.

Referring to FIGS. 1-3, there is illustrated a wall storage arrangement 10 according to the present invention, which wall storage arrangement is releasably mounted on an upright wall 11. This upright wall 11 in the illustrated embodiment is defined by a plurality of upright wall panels 12 which are serially joined together, such panels typically being prefabricated. The construction and function of the panels 12 is generally conventional and well-known.

The upright storage arrangement 10 in the illustrated embodiment functions primarily as a shelf arrangement and is defined principally by a one-piece horizontally elongate L-shaped shelf unit 13 which includes a generally horizontally oriented base leg 14 which, adjacent a rear edge thereof, rigidly joins to a vertically upwardly protruding upright leg 15. The base leg 14 functions as a shelf and is cantilevered horizontally forwardly from the lower edge of the upright leg 15, and defines thereon a generally horizontally planar upper surface 16 for supportive engagement with objects and the like which can be supportingly positioned thereon.

The L-shaped shelf unit 13, as illustrated in FIG. 3, is preferably provided with an enlarged nose part 21 extending lengthwise along the front free edge of the base leg 14. This nose part 21 defines therein a groove 22 which extends lengthwise throughout the full length of the base leg and which opens rearwardly toward the region disposed below the base leg. The groove 22, as defined within the enlarged nose part 21, has the front side thereof closed off by a front wall 23 which at its lower end joins to an inwardly or rearwardly projecting lower leg part 24, the latter being generally L-shaped. These wall parts 23 and 24 are all part of the enlarged nose part 21, and cooperate to define the groove 22.

The groove 22 mounts therein a horizontally elongate reinforcing beam 25 which, in the illustrated embodiment, has a generally C-shaped cross section which is compatible with the shape of the groove 22 so as to be snugly received therein. The reinforcing beam 25 is positioned within the groove 22 by being slidably inserted into the groove from one end thereof. The preferred snug engagement between the reinforcing beam 25 and the wall of the groove 22 is sufficient to retain the reinforcing beam in position. At the same time, this reinforcing beam 25, preferably constructed as a thin-wall metal channel, provides significant strength against both bending and twisting, particularly along the cantilevered front edge of the base leg 14, thereby imparting significantly improved strength and durability to the overall shelf unit.

The enlarged nose part 21 of the base leg 14, as illustrated by FIG. 3, is also preferably provided with an undercut T-shaped groove 26 opening inwardly from the vertical front face thereof. This undercut groove 26 can be utilized to permit insertion of a decorative or identification strip therein, or alternately can be used for permitting attachment of a suitable trim piece, such as a nose piece 27 as indicated by dotted lines in FIG. 3.

The shelf unit 13 of the present invention also has an electrical accessory accommodating arrangement 31 associated with and extending lengthwise along the underside 32 of the base leg 14. This electrical accessory accommodating arrangement 31 includes a main groove 33 which opens upwardly from the lower surface 32 of the shelf 14 and extends lengthwise throughout the entire length of the shelf. This groove 33, as illustrated by FIG. 3, is preferably disposed approximately midway between the front and rear edges of the shelf 14.

The electrical accessory accommodating arrangement 31 includes a pair of generally parallel but sidewardly spaced low-voltage conductors or wires 34, 35 (FIG. 3A) which extend lengthwise throughout the entire length of the groove 33 and which are disposed adjacent opposite sides of the groove in the vicinity of the closed upper end thereof. The low-voltage conductors 34, 35 are effectively embedded in the material defining the shelf 14, being adjacent but slightly spaced inwardly from adjacent side wall of the groove 33. The conductors 34, 35 are accessible from the groove 33 by means of small transversely-projecting branch or secondary grooves 36 which also extend lengthwise throughout the entire length of the main groove 33.

The base leg or shelf 14 is also preferably provided with one, and preferably at least two, hanger-accommodating secondary grooves 37 and 38 which permit additional accessories to be mounted on and suspended downwardly from the shelf unit. The hanger-accommodating grooves 37 and 38 preferably extend in parallel relationship lengthwise throughout the entire length of the shelf 14. These grooves 37, 38 open upwardly from the underside 32 and, in the illustrated embodiment, have an undercut portion 39 which enables an accessory hanger to be inserted upwardly and then angularly locked within the groove. The pair of hanger-accommodating grooves 37, 38 are preferably disposed in sidewardly spaced relationship (i.e., spaced sidewardly in the front-to-back direction of the shelf 14) so that the electrical accessory accommodating groove 33 is disposed in parallel relationship therebetween. This enables accessories which engage within the groove 37 and 38 to be selectively positioned either more closely adjacent the front edge of the shelf, or more closely adjacent the rear edge thereof, thereby providing increased flexibility with respect to not only the position but also the size of the accessory, and at the same time avoiding interference with electrical accessories which engage within the groove 33, as explained in greater detail hereinafter.

Figure 4:
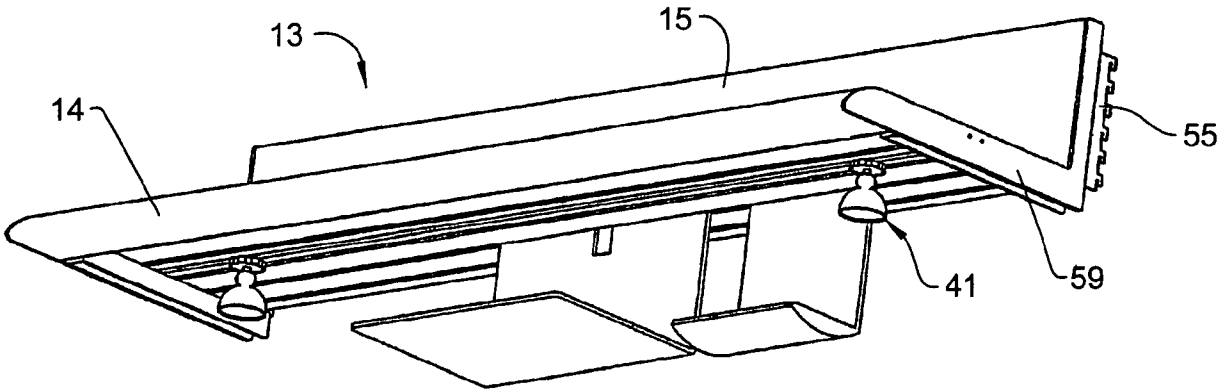
FIG. 4 is a perspective view of the shelf and illustrating lights and other accessories engaged within the groove of the shelf and suspended downwardly therefrom.
Figure 5:
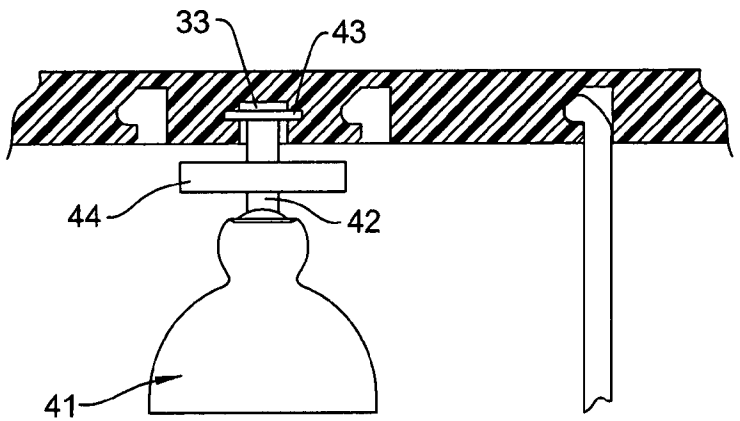
FIG. 5 is an enlarged, fragmentary sectional view showing attachment of an electrical device, such as a light, within the electrified track provided on the underside of the shelf unit.

As illustrated by FIGS. 4 and 5, an electrical accessory 41, such as a low-voltage light, can be detachably engaged within the groove 33 to provide lighting in the region located below the shelf 14. The electrical accessory or light 41, in the illustrated embodiment, includes a bracket 42 which protrudes upwardly for insertion into the groove 33. This bracket adjacent the upper end thereof mounts a conductive head part 43 having a width which enables it to be inserted upwardly into the groove 33 for elevational alignment with the secondary grooves 36, with this conductive head part 43 then being rotatable through about 90 degrees (i.e., about one-quarter turn) so as to project into the secondary grooves 36 and create a conductive engagement with the low-voltage conductors 34 and 35. This rotation of the conductive head part 43 is accomplished by means of a one-quarter turn connector 44 which is mounted on the bracket 42 in a position whereby it is disposed closely adjacent the underside of the shelf so as to be manually accessible to permit rotative turning thereof. This enables the accessory or light 41 to be electrically joined to the low-voltage conductors 34-35 which hence function as electrical supply conductors for the light. This engagement of the accessory or light 41 to the conductors 34-35 is structurally and functionally similar to the cooperation which exists with conventional track lighting, whereby further detailed description thereof is believed unnecessary.

Figure 7:
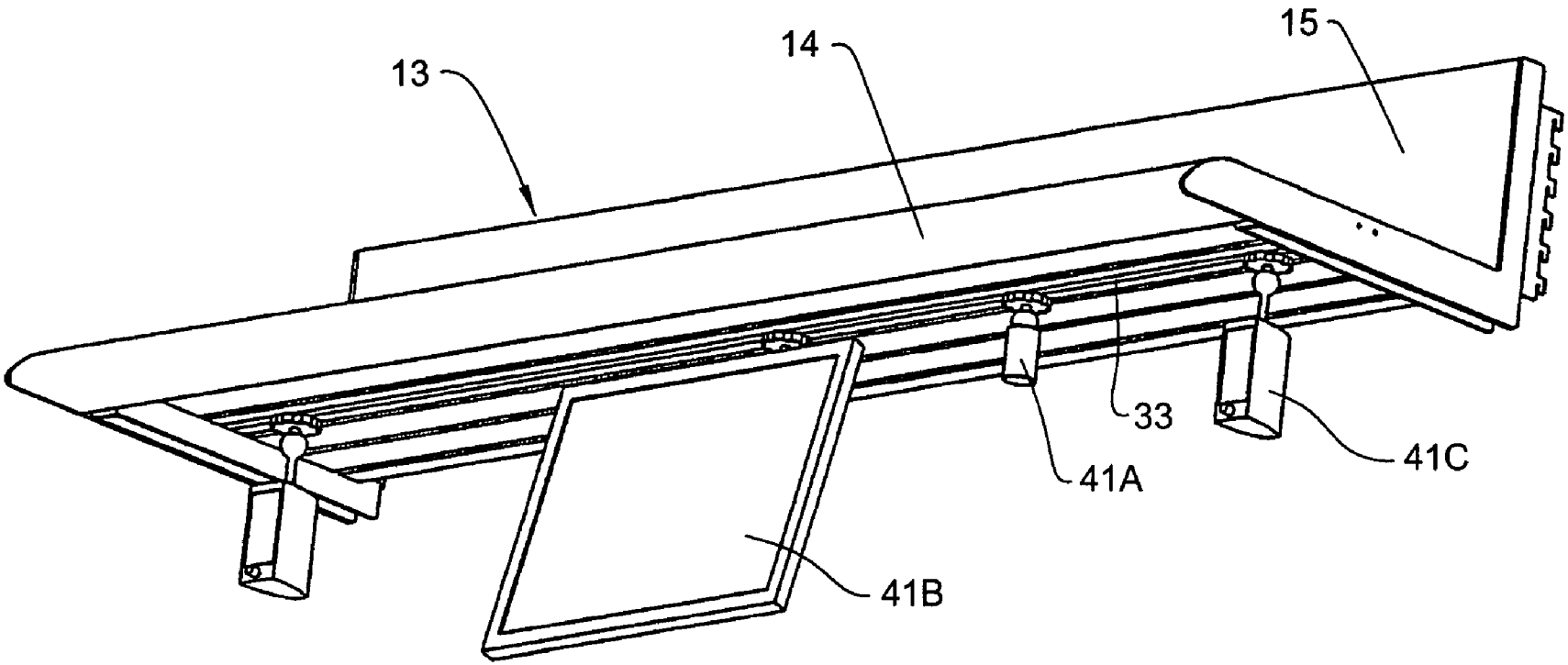
FIG. 7 is a view similar to FIG. 4 but illustrating other electrical devices engaged with and suspended from the shelf.

While the electrical accessory accommodating arrangement 31 has been described and illustrated above with respect to an electrical accessory 41 formed as a low-voltage light or lamp, other low-voltage accessories can also be provided and connected to the arrangement 31 in the same manner as described above. For example, and with reference to FIG. 7, there is illustrated several different types of low-voltage electrical accessories which can be electrically and mechanically engaged with the accessory accommodating groove 33. For example, there is illustrated a low-voltage outlet 41A, a monitor screen 41B, and a wireless speaker arrangement 41C. These different accessories all mechanically and electrically mount to the electrical accessory accommodating arrangement 31 in the same manner described above relative to the light accessory 41.

Figure 6:
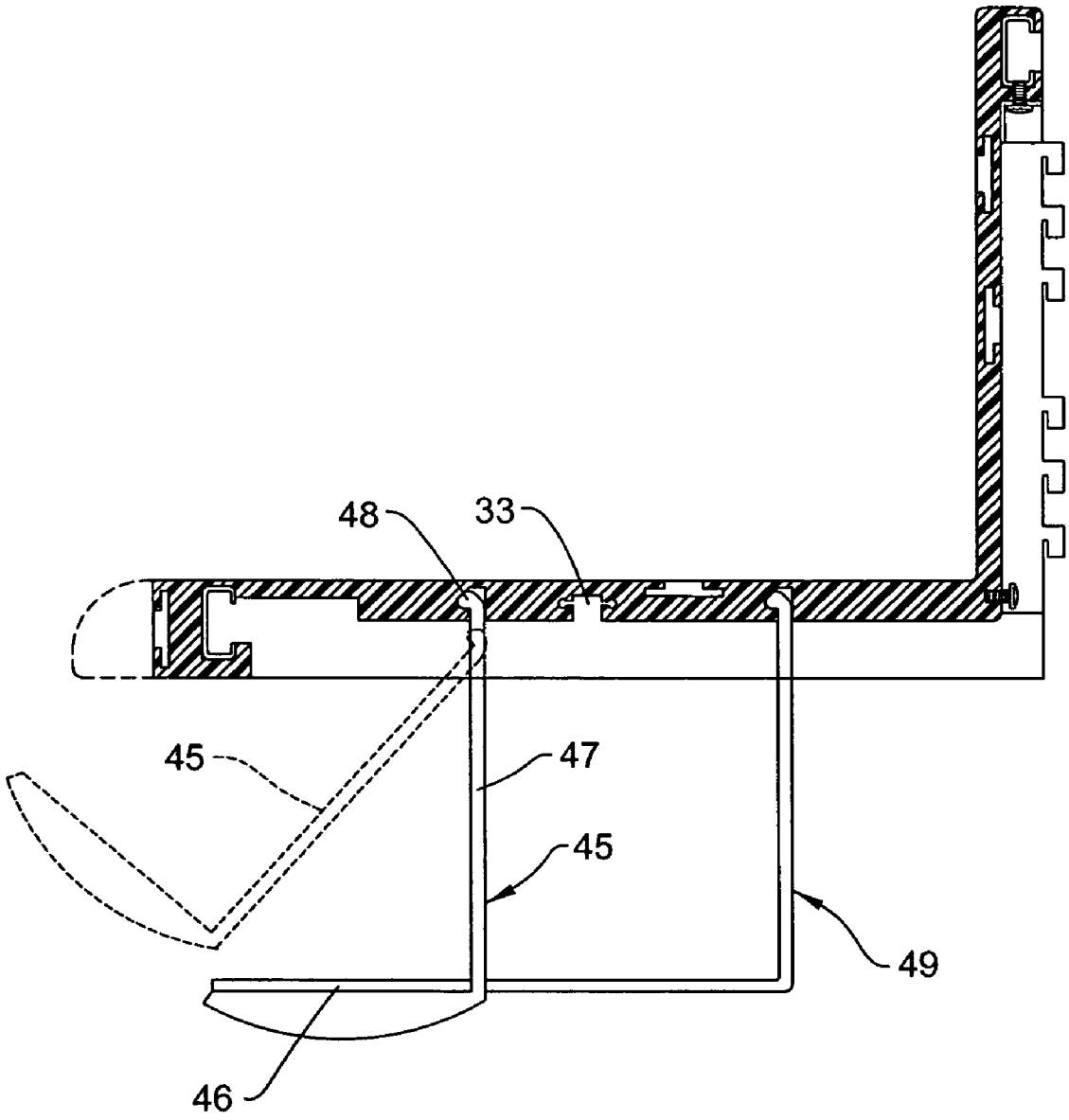
FIG. 6 illustrates attachment of an accessory, such as a small shelf or pencil tray, to the underside of the shelf.

The shelf unit 13 of this invention, as illustrated by FIGS. 4 and 6, also permits structural accessories 45, such as shelf accessories, to be mounted therein by engagement within one of the hanger-accommodating grooves 37 or 38. For example, as illustrated in FIG. 6, an accessory 45 can be detachably suspended from the horizontal shelf 14 at any location lengthwise therealong, and for this purpose the accessory 45 includes a generally horizontally oriented tray 46 which is mounted to and cantilevered from a lower end of an upright mounting bracket 47, the latter having an upper hook-shaped or nose-shaped end 48 which is adapted to be inserted into and engaged within either of the grooves 37 and 38. The upper hook or nose end 48 enables the bracket 47 to be disposed in angled relationship as it is inserted upwardly into the grooves substantially as illustrated by dotted lines in FIG. 6, with the bracket then being rotated rearwardly to cause the upper end 48 to engage within the nose part 39 of the respective groove 37 or 38, thereby maintaining the bracket in a secure but downwardly suspended relationship.

An alternate accessory construction is also illustrated in FIGS. 4 and 6, namely a shelf accessory 49, the latter being substantially identical to the tray accessory 45 except that the lower end of the bracket associated with the tray accessory 45 mounts thereon a shallow upwardly opening tray structure 46, such as a pencil tray or the like, whereas the accessory 49 has a generally horizontal shelf carried on the lower end of the bracket.

Referring again to FIG. 3, the upright leg 15 of the L-shaped shelf unit 13 is preferably constructed in a manner similar to the base leg or shelf 14 in that it is preferably provided with an enlarged head part 51 formed on and extending lengthwise along the upper free edge thereof. This enlarged head part defines therein a groove 52 which extends lengthwise throughout the length of the shelf unit, and which opens rearwardly. The groove 52 is configured generally the same as the groove 22 associated with the shelf 14, in that each has a generally T-shaped configuration, whereby the groove 52 as formed in the head part 51 also snugly accommodates therein a horizontally elongate reinforcing beam 53, the latter being a generally C-shaped metal beam which can be identical to the reinforcing beam 25 as described above. The reinforcing beam 53 is slidably inserted into the upper head part 51 by being inserted into the groove 52 from one end thereof. When inserted into the groove, the metal reinforcing beam 53 and its snug engagement with the side walls of the groove, particularly along the upper and lower edges thereof, provides the upper head part 52, and hence the overall shelf unit, with significantly improved strength, particularly with respect to bending and twisting.

The shelf unit 13 of this invention, as described above, is preferably constructed from a formable and specifically an extrudable material, preferably an electrically insulative material such as a plastic material, to define a monolithic one-piece structure which can preferably be extruded in a lengthwise direction, whereby the shelf unit can be economically manufactured and provided with all of the grooves extending lengthwise thereof during the extrusion process. Shelves of different lengths can be easily formed by appropriate transverse cutting of the continuous extrusion. The provision of the enlarged nose and head parts, and their ability to accommodate therein metal reinforcing beams 25 and 53, provides the extruded shelf unit with significantly improved strength and rigidity, while at the same time resulting in a shelf unit which can be easily and economically manufactured, and at the same time results in a shelf of desirable strength and rigidity and of reasonable weight.

To secure the shelf unit 13 to the upright wall 11, the shelf unit can be provided with conventional mounting hangers 55 (FIGS. 2 and 3) which enable the shelf unit to be secured to frame structures associated with the wall panels 12. In this regard, the mounting hangers 55 are vertically elongated, are generally L-shaped in cross section, and include a plurality of vertically spaced L-shaped hooks 56 associated with the rearwardly projecting leg thereof. These hooks 56 engage within slots associated with a vertical row of slots formed in an upright frame member (not shown) associated with the wall panel 12, which frame members are disposed adjacent opposite upright edges of the wall panel, whereby the shelf has a length which corresponds to the wall panel length, such attachment arrangement being conventional.

In the illustrated arrangement, the mounting hangers 55 can be secured to the rear side of the upright leg 15 of the shelf unit by a pair of screws 57 and 58. In this case, the lower screw 57 extends through one leg of the hanger bracket 55 directly into the shelf unit generally at the apex between the base and upright legs, whereas the top screw 58 preferably extends through an upwardly protruding bracket 58A which protrudes upwardly and overlies the bottom wall of the upper head part 51. This enables the top screw 58 to be screwed upwardly through the top head part into the top reinforcing beam 53 to provide significantly improved structural strength and connectivity.

As illustrated by FIGS. 1 and 2, the ends of the shelf unit 10 can be suitably covered by means of end caps 59 defined as thin plate-like covers, either metal stampings or molded plastic covers, which have an L-shaped configuration generally corresponding to the cross-sectional configuration of the shelf unit 13. These end covers 59 are preferably provided with appropriate retaining clips protruding inwardly therefrom, which clips engage within selected ones of the grooves which extend lengthwise of the shelf unit for permitting secure attachment of the covers thereto.

Figure 8:
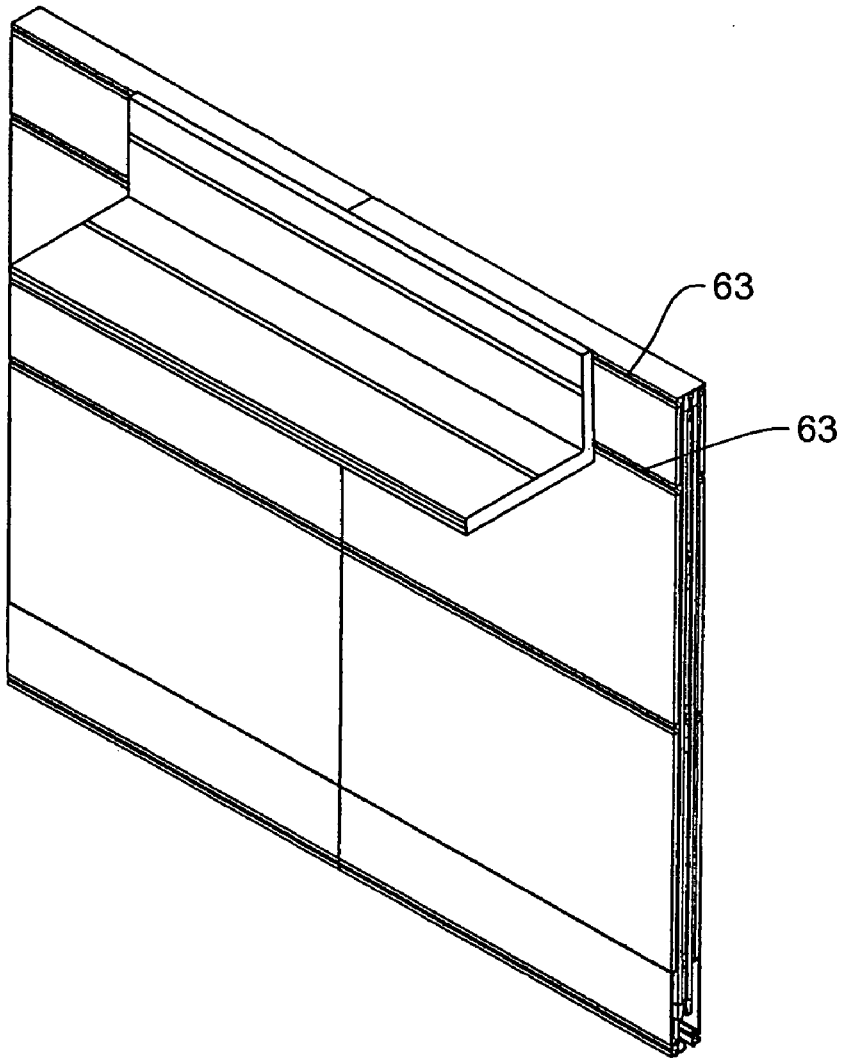
FIG. 8 is a perspective view similar to FIG. 1 but illustrating a different mounting technique, namely an off-module mounting of the shelf to the wall.
Figure 9:
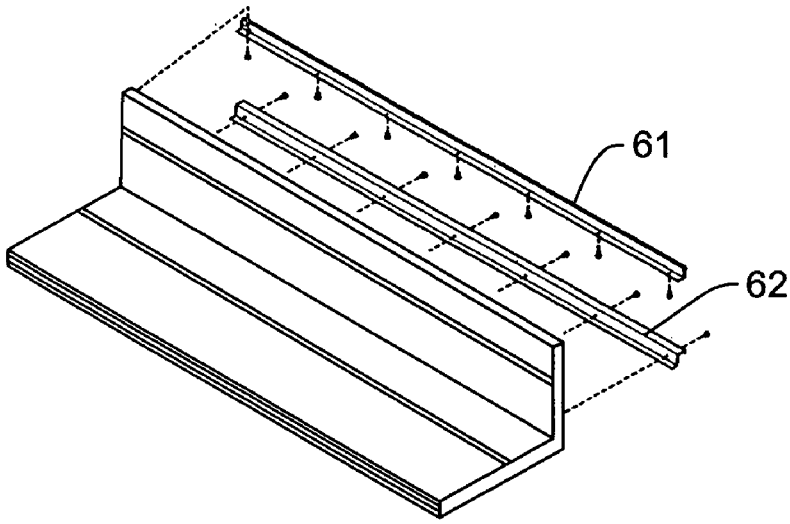
FIG. 9 is a perspective view of the shelf illustrated in FIG. 8.
Figure 10:
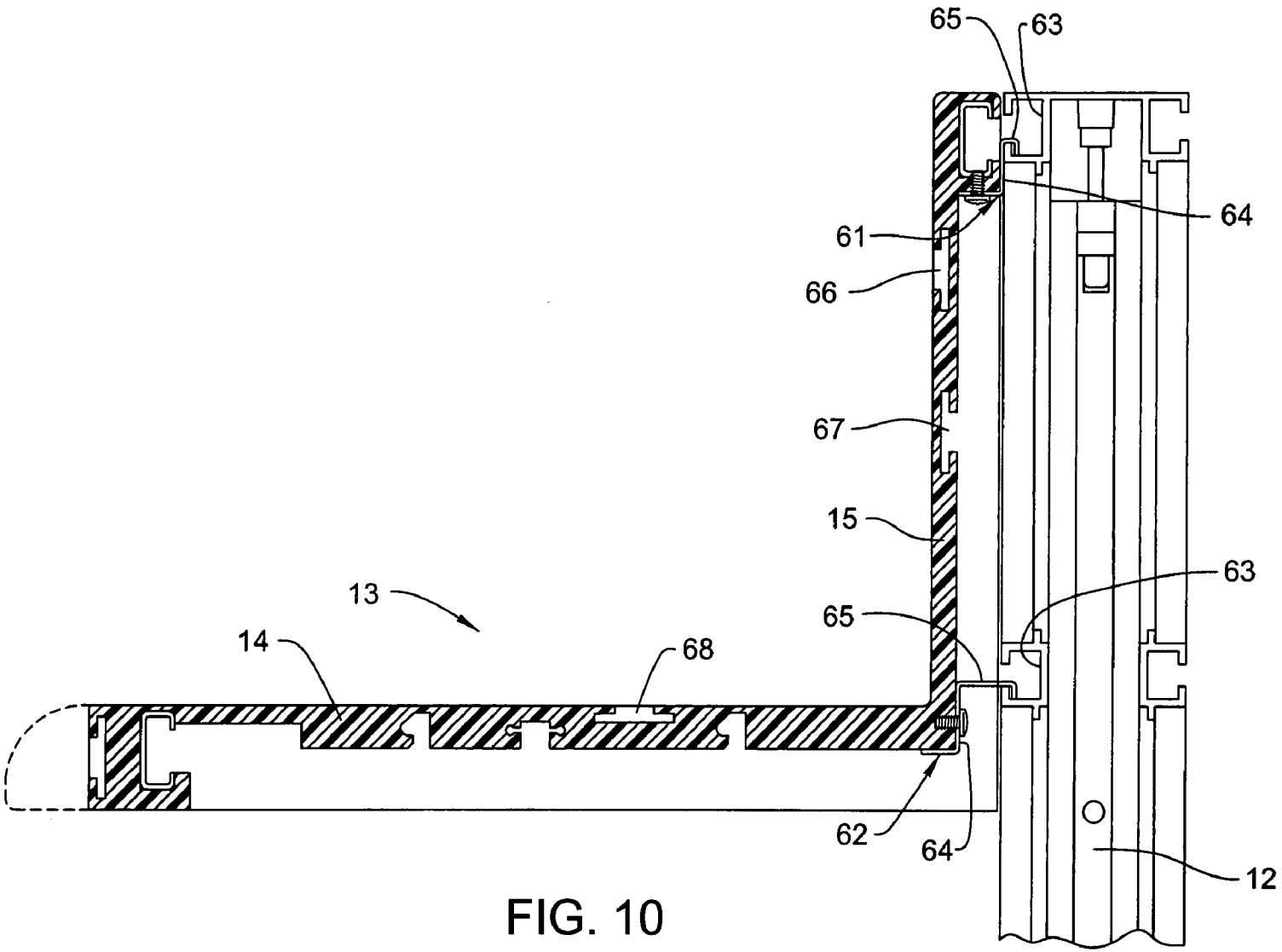
FIG. 10 is an enlarged, transverse cross-sectional view of the shelf illustrated in FIG. 9.

As an alternate mounting technique for the shelf unit 10, particularly to permit the shelf unit to be mounted on an upright wall system at any location therealong, independent of the width of the individual upright wall panels 12, the shelf unit can be provided with upper and lower mounting rails 61 and 62, respectively, the latter being adapted for engagement within horizontal rails or channels 63 associated with the upright wall arrangement substantially as illustrated by FIGS. 8-10. In this situation, the upper and lower rails 61 and 62 are each generally Z-shaped in cross section and include an intermediate or upright leg part 64 which abuts a rear side of the upright leg 15, and this upright wall part 64 joins to a generally hook-shaped upper leg 65 which protrudes rearwardly and is adapted to project into and create a secure engagement within one of the horizontal channels 63 which extend horizontally across the face of the respective wall panels. This arrangement enables the shelf unit to be securely attached to a face of the wall at any location horizontally therealong, independent of the width of the individual wall panels, and provides flexibility with respect to both the length and location of the shelf unit in that it can be mounted in an off-modular relationship relative to the module size (i.e. width) of the wall panels.

The upright leg 15 of the shelf unit is also preferably provided with additional mounting grooves associated therewith to provide increased flexibility of use. This is illustrated by the T-shaped groove 66 which opens inwardly from the front face of the upper leg 15 and extends horizontally throughout the lengthwise extent thereof. A further T-shaped groove 67 may also be provided so as to open inwardly from the rear face of the upper leg and extend horizontally therealong. A still further T-shaped groove can be formed in the upper surface of the base leg 14 to permit mounting of upright shelf dividers and the like.

Figure 11:
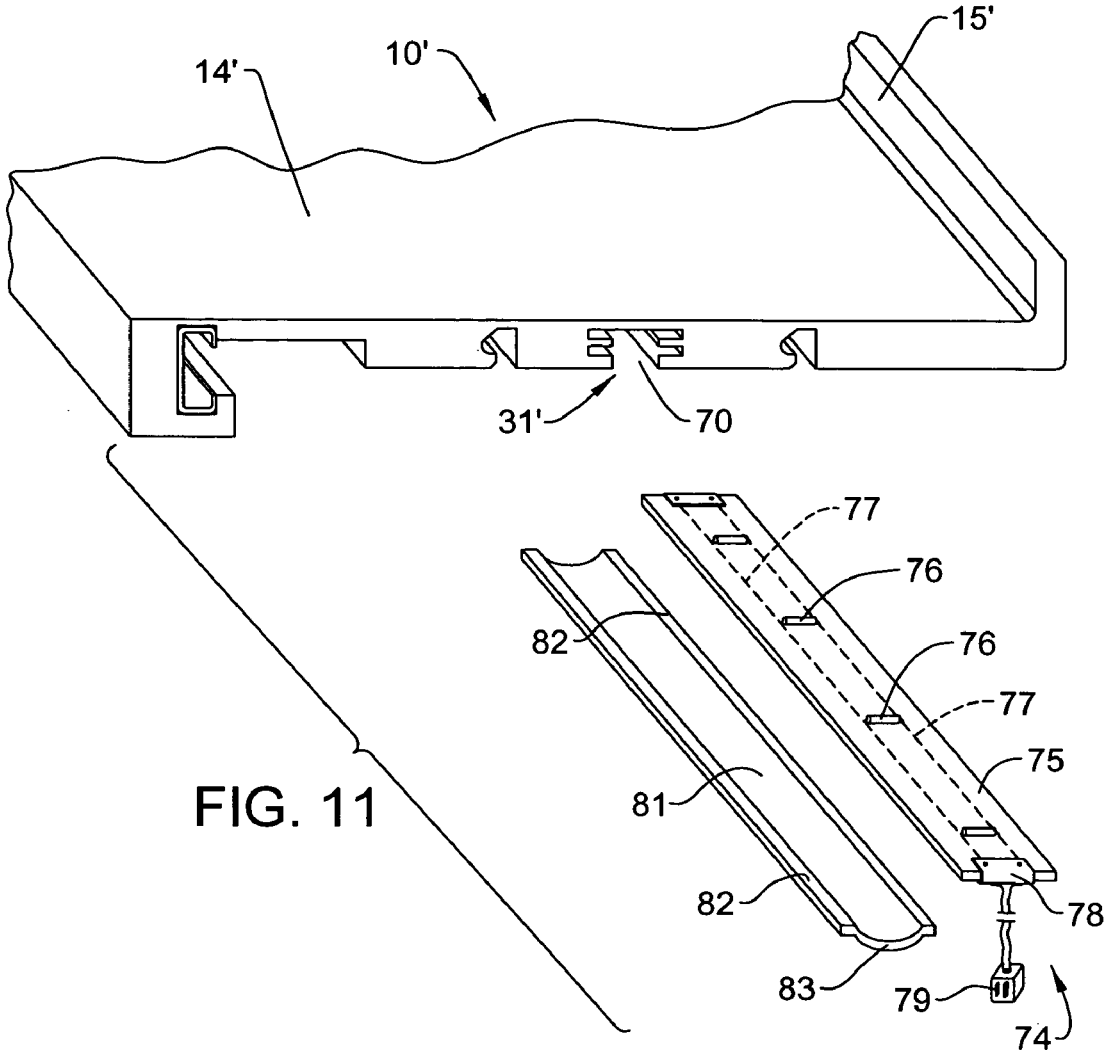
FIG. 11 is an exploded, perspective view of an alternate construction of the improved shelf of the present invention, and illustrating a light strip which mounts under and extends lengthwise along the shelf.
Figure 12:
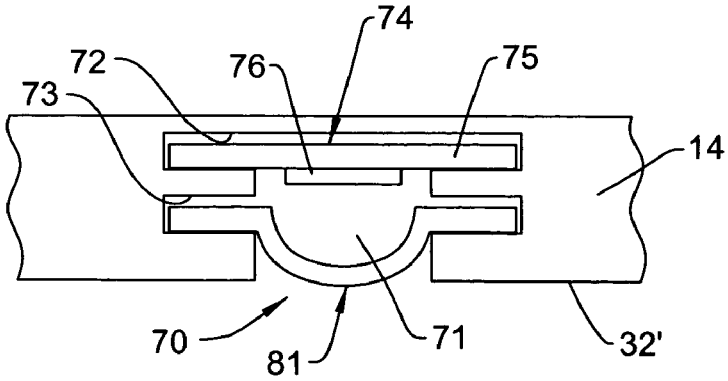
FIG. 12 is an enlarged fragmentary cross-sectional view showing the assembly of the light strip to the shelf.

Referring now to FIGS. 11-12, there is illustrated a modified shelf arrangement 10' which is constructed generally in accordance with the shelf arrangement 10 described above, except that the modified shelf arrangement 10' has a modified electrical accessory accommodating arrangement 31' associated with and extending lengthwise along the underside of the base leg 14'.

More specifically, this arrangement 31' has a groove arrangement 70 which includes a main groove 71 which opens upwardly in the main leg 14' from the undersurface 32' thereof, which groove 71 extends horizontally throughout the lengthwise extent of the shelf unit. The groove 71 is preferably disposed substantially midway between the front and rear edges of the base leg 14. The main groove 71 in turn communicates with an upper secondary groove 72 which projects sidewardly in both directions away from the main groove substantially at the level of the upper or blind end of the main groove. Upper secondary groove 72 cooperates with the main groove 71 to define a generally T-shaped cross section. A further or lower secondary groove 73 is also provided and also opens sidewardly from opposite sides of the main groove 71 at an elevation located between the underside 32' and the upper secondary groove 72. These secondary grooves 72 and 73 extend generally in parallel horizontally relationship, and both extend throughout the full lengthwise extent of the base leg 14.

The groove arrangement 70, as defined by the main groove 71 and the secondary groove 72 and 73, cooperates with a lighting arrangement 74 which is releasably mounted on the shelf 14 and extends lengthwise therealong for providing lighting to the region below the shelf 14. This lighting arrangement 74 is preferably a low-voltage direct-current arrangement and is defined by an elongate plate-like light board 75 provided with a plurality of energizable light devices 76, such as LEDs, mounted thereon in lengthwise spaced relationship therealong, which LEDs are effectively coupled in parallel relationship to one another by being electrically joined to a pair of conductive strips 77 which extend lengthwise of the light board. The conductive strips 77, adjacent one end of the light board, are suitably connected to an electrical end connector 78 which joins through a suitable flexible conductive wire to a conventional transformer plug 79, the latter being insertable into any conventional electrical outlet.

The light board 75 is positioned within the groove arrangement 70 by slidably inserting the light board into the upper secondary groove 72 from adjacent one end of the shelf unit, whereupon the light board is supported by the secondary groove while positioning the main center portion of the light board, and the LEDs mounted thereon, directly within the downwardly opening main groove 71.

The lighting arrangement 74 also preferably includes a removable elongate lens or diffuser 81 constructed of a conventional transparent or translucent material and positioned on the shelf 14 at a location below the light board 75 for controlling the light which is generated and emitted downwardly through the mouth of the groove 71. The lens or diffuser 81 extends throughout the entire length of the groove arrangement and has lengthwise-extending edge flanges 82 which are supported within the lower secondary groove 73, with the lens or diffuser being slidably inserted lengthwise of the groove 71 for proper disposition therein. The lens 81 in the illustrated embodiment has a center body part 83 which preferably has a downwardly protruding convex or rounded configuration which is sized to effectively occupy and protrude downwardly at a lower open end of the main groove 71 to hence permit the light as emitted at the LEDs 76 to be diffused over a wider angular area at a location below the shelf 14.

It will be appreciated that, with the arrangement described herein, a low voltage electrical supply can be readily supplied to and be available lengthwise along the conductors 34-35 (FIGS. 1-3) which extend lengthwise along the shelf, thereby facilitating the connection of electrical accessories to the shelf and to the electrical conductors 34-35. Alternately, a low-voltage lighting arrangement 74 can be readily inserted into the groove associated with the shelf and extend lengthwise therealong to provide improved low-voltage lighting for the region located below the shelf. Whether the low voltage is supplied to the conductors 34-35 or to the lighting arrangement 74, in either case the low voltage connection, such as depicted in FIG. 11, can be readily coupled to any available conventional electrical outlet, such outlet traditionally being available directly in the wall panels 12 which define the supportive wall for the shelf, such electrical outlets conventionally being provided either adjacent the baseboard or at a beltline location.

The arrangement of the present invention also enables several shelves to be disposed in directly adjacent and aligned relationship, with the electrical conductors 34-35 or lighting arrangements 74 in the adjacent aligned shelves being directly electrically connected, such as by means of a suitable compact electrical jumper being connected between the adjacent ends of either the conductors 34-35 or the light boards 75, whereby a series of shelves can be electrified by a single supply cord coupled solely to one end of the series.

It will be understood that the shelf unit of this invention can be used to permit formation of a closed storage unit, such as an openable overhead storage unit, by providing the shelf unit with top and end walls and an openable door.

While the shelf 13 as described above is L-shaped and includes both horizontal and upright legs 14 and 15 respectively, it will be recognized that the shelf construction may be created by joining separate horizontal and upright legs together, and the horizontal leg may be formed from an extrudable material so as to be of a monolithic one-piece construction, and such horizontal leg can be utilized independently of the upright leg.

Figure 13:
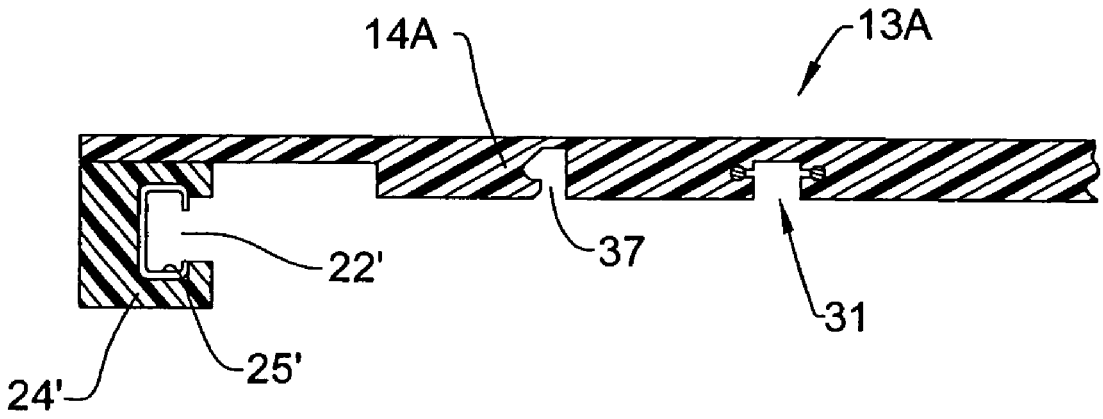
FIG. 13 is a fragmentary sectional view showing a variation in the construction of the front edge of the shelf.

Referring now to FIG. 13, there is illustrated a variation of the construction for the horizontal shelf 14A as associated with the shelf unit 13A of this invention. In this variation, while the shelf 14A is again preferably formed as a monolithic one-piece construction, such as by being extruded of a formable material, the enlarged front nose part 24' can be constructed as a separate member which can also preferably be formed as a monolithic one-piece extrusion formed of the same material as the horizontal shelf 14A. This nose part 24' is again provided with a rearwardly opening channel 22' containing therein a metal reinforcing beam 25' extending lengthwise thereof. This separate reinforcing nose part 24' can be fixedly secured to and extend lengthwise along the entire front edge of the shelf 14A so as to again provide significant load bearing reinforcement along the front edge of the shelf. For this purpose the nose part 24' can be adhesively adhered or bonded to the shelf 14A along the entire lengthwise extent thereof, whereby the resulting assembled horizontal shelf again has a one-piece construction which, while formed from two separate members, nevertheless still provides improved performance and appearance so as to provide characteristics which again approach that achieved by the monolithic one-piece construction illustrated by FIGS. 3 and 10. The front nose part 24', as a replacement for or preferably in addition to the adhesive securement of the nose part to the shelf, can be fixedly joined to the shelf by a series of closely-spaced fasteners such as screws which extend vertically upwardly through the nose part for engagement with the shelf part.

Figure 14:
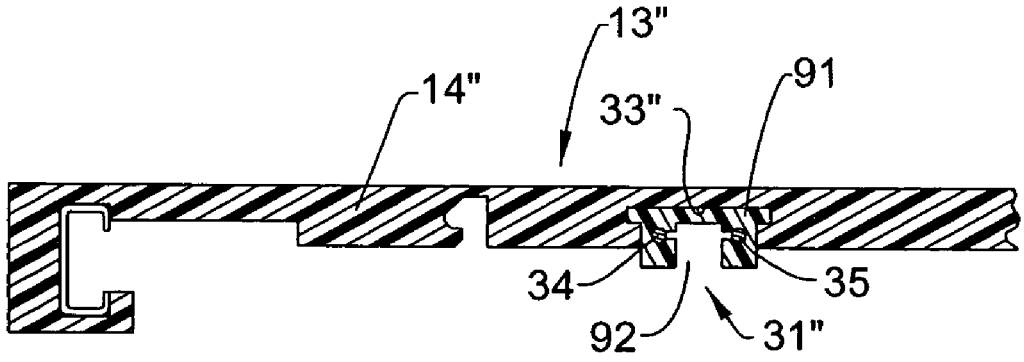
FIG. 14 is a fragmentary sectional view showing a further variation in the construction of the shelf.

A still further variation of the invention is illustrated by FIG. 14 wherein the horizontal shelf 14" as associated with the shelf unit 13" has a modified electrical accessory accommodating arrangement 31" associated with the underside thereof. This modified arrangement 31" resembles the arrangement 31 described above in that it is associated with the underside of the shelf and extends lengthwise therealong, such arrangement again including a generally undercut or T-shaped groove 33" formed in the underside of the shelf and extending lengthwise thereof. This groove again is provided so as to accommodate a pair of sidewardly spaced but generally parallel electrical conductors 34, 35 which extend lengthwise of the shelf. In this modified arrangement 31", however, the conductors are mounted on and embedded within a separate insert mounting member 91 which preferably has a generally T-shaped cross-section so that it can be slidably inserted into and extend lengthwise of the groove 33" while being vertically retained therein. This insert mounting member 91 is preferably formed of a formable electrically-insulating material, and is provided with a groove 92 which opens upwardly from the bottom surface thereof while extending lengthwise throughout the extent of the mounting member. This groove 92 also preferably has undercut side grooves extending lengthwise along opposite sides thereof for accessing the electrical conductors 34, 35 embedded therein in generally the same manner as described above with respect to the electrical accessory arrangement 31. While the conductors 34, 35 will again typically be low-voltage direct-current conductors, nevertheless this construction and the provision of the conductors mounted within a separate insulative insert may also be utilized to accommodate typical higher voltage conductors such as conventional 110 volt alternating current conductors. The modified arrangement 31" will permit electrical accessories to be releasably attached thereto in the same manner as described above with respect to the electrical accessory arrangement 31.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A shelf arrangement for attachment to an upright wall, comprising:

a monolithic one-piece shelf unit constructed of an extrudable material;

said shelf unit being horizontally elongated and having an L-shaped cross section defined by a horizontal leg part which adjacent a rear edge is monolithically joined to a lower edge of an upright leg part which is cantilevered upwardly in generally transverse relation to the lower leg part, said lower leg part defining thereon a generally horizontally planar upper surface which functions as a support surface for removable objects, said lower and upright leg parts extending horizontally throughout the lengthwise extent of the shelf unit;

said lower leg part having a nose part which extends lengthwise along a horizontally extending free edge thereof, said nose part defining therein a channel-like groove extending lengthwise therealong throughout the length of said lower leg part;

a horizontally elongate metal reinforcing beam positioned within and extending lengthwise throughout substantially the lengthwise extent of said groove and maintained in engagement with said nose part for reinforcing the nose part of said lower leg part against vertical bending due to external loading of said upper surface;

said lower leg part having at least one main groove formed therein and opens downwardly through an undersurface thereof, said main groove extending horizontally lengthwise throughout the lengthwise extent of the lower leg part in generally parallel but rearwardly spaced relation from the lengthwise extending free edge, said main groove in cross section having an undercut configuration to permit a removable bracket structure associated with a detachable accessory to be suportingly engaged therein; and a mounting bracket attached to said shelf unit and projecting rearwardly thereof for supportive engagement with an upright wall.

2. A shelf arrangement according to claim 1, wherein said lower leg part has a pair of generally parallel and sidewardly spaced elongate low-voltage electrical conductors mounted thereon and extending horizontally lengthwise thereof, said conductors being disposed adjacent opposite sides of said groove and accessible solely from said groove, and a detachable accessory bracket structure having a conductive member which, when positioned in said groove, is angularly displaced into conductive contact and engagement with said conductors.

3. A shelf arrangement according to claim 2, wherein said lower leg part includes a secondary groove which is formed therein and opens downwardly from the undersurface thereof, said second groove being sidewardly spaced from but extending generally parallel to said main groove and extending throughout the lengthwise extent of said lower leg part, said secondary groove having a cross section for engaging and securing a bracket associated with a second detachable accessory.

4. A shelf arrangement according to claim 2, including a low-voltage power supply cord arrangement which connects to said conductors adjacent one end of said lower leg part, said cord arrangement at the other end thereof having a plug-in transformer arrangement for connection to a conventional electrical outlet.

5. A shelf arrangement for attachment to an upright wall, comprising:

a horizontally elongate shelf unit having a shelf part which extends horizontally throughout the horizontal extent of the shelf unit and defines thereon a substantially horizontally planar upper surface for supportive engagement with removable objects, said shelf part defining thereon a horizontally extending front free edge which is disposed in forwardly spaced relationship from an upright wall;

bracket structure for attaching said shelf unit to said upright wall so that said shelf unit is positioned adjacent and cantilevered outwardly from an upright side surface of said wall;

said shelf part having an electrical accessory attachment arrangement associated with an underside thereof and extending lengthwise therealong;

said electrical accessory attachment arrangement including a horizontally elongate groove which is formed in said shelf part and which opens downwardly from the underside of said shelf part, said groove extending lengthwise throughout the length of said shelf part in generally parallel relationship to said front edge, said groove being spaced rearwardly from said front edge but forwardly from a rear edge of said shelf part, and a pair of generally parallel and sidewardly spaced elongate electrical conductors mounted on said shelf part adjacent said groove and accessible from said groove, said conductors extending lengthwise of said shelf part; and a detachable accessory engaged within said groove and projecting downwardly from said shelf part, said accessory having a mounting part which protrudes upwardly into and is stationarily engaged within said groove and which has an electrically conductive part disposed in conductive engagement with said sidewardly-spaced pair of electrical conductors.

6. A shelf arrangement according to claim 5, wherein said shelf part is a monolithic one-piece construction of an electrically insulative material and said electrical conductors are embedded therein adjacent opposite sides of and accessible solely from said groove.

7. A shelf arrangement according to claim 6, wherein said shelf unit includes an upright leg part which extends generally in transverse relationship to said shelf part and is monolithically joined to said shelf part adjacent the rear edge thereof so that the shelf unit has a generally L-shaped cross section.

8. A shelf arrangement according to claim 6, wherein said shelf part has a bracket-accommodating groove formed therein and opening downwardly through the underside thereof and extending horizontally throughout the lengthwise extent of said shelf part in rearwardly spaced but generally parallel relationship to said front edge, said bracket accommodating groove being sidewardly spaced relative to said electrical-accessory accommodating groove.

9. A shelf arrangement according to claim 6, wherein an enlarged nose part extends lengthwise along the front free edge of said shelf part, said nose part defining therein a channel which opens rearwardly and extends lengthwise therealong, and an elongate metal reinforcing beam positioned within and extending lengthwise of said channel in snug engagement with said nose part for providing bending strength in the lengthwise direction of the shelf part.

10. A shelf arrangement according to claim 9, wherein said nose part is formed monolithically with said shelf part.

11. A shelf arrangement for outward cantilevered attachment to an upright wall, comprising:

a horizontally elongate shelf part having a lengthwise-extending rear edge positioned adjacent an upright wall and a lengthwise-extending free edge disposed in forwardly spaced relation from the upright wall, said shelf part defining thereon a substantially horizontally planar upper support surface for supportive engagement with removable objects positioned thereon;

a low-voltage lighting arrangement carried on said shelf part adjacent an underside thereof for directing light downwardly below said shelf part;

said low-voltage lighting arrangement including a horizontally elongate groove which is formed in said shelf part and opens downwardly from the underside thereof and extends lengthwise of said shelf part in generally rearwardly spaced but parallel relationship to said free edge, said groove having undercut groove portions on opposite sides thereof in upwardly spaced relation from the underside of said shelf part;

said low-voltage lighting arrangement including a horizontally elongate light board positioned within said groove and supportingly engaged within the sidewardly opposed undercut groove portions, said light board being elongated along said groove and mounting thereon a plurality of electrically innerconnected low-voltage lights in spaced relationship therealong;

a lens member supportingly engaged on said shelf part and extending lengthwise along said groove adjacent a mouth thereof in downwardly spaced relation from said light board for controlling downward emission of light from said low-voltage lights; and a low-voltage supply cord having one end thereof electrically engaged with said light board, said supply cord being coupled to a plug and transformer arrangement which can be electrically joined to a conventional electrical outlet.

12. A shelf arrangement according to claim 11, wherein said groove has a first opposed pair of said sideward undercut groove portions adjacent the upper end of the groove and extending lengthwise along the groove for supportive engagement with opposite edge parts of said light board, said groove having a second sidewardly opposed pair of undercut groove portions which are spaced downwardly from said first undercut groove portions and which supportingly engage edge flanges which extend lengthwise of said lens.

13. A shelf arrangement according to claim 12, wherein said lens has a downwardly protruding arcuate-shaped center part which extends between said edge flanges, said center part protruding downwardly through the mouth of said groove.

14. A shelf arrangement according to claim 12, wherein said shelf part has an accessory-accommodating groove opening downwardly from the underside thereof and extending lengthwise of said shelf part in sidewardly spaced but parallel relationship to said front edge, said accessory accommodating groove having an undercut cross section to permit a bracket associated with a detachable accessory to be supportingly engaged therein.

15. A shelf arrangement according to claim 14, wherein said shelf part is a one-piece monolithic structure of an extrudable material having said grooves formed in the underside thereof, and an enlarged nose part fixed to said shelf part and extending therealong and defining a front edge thereof, said nose part having an interior channel which opens rearwardly along the underside of the shelf part, and a horizontally elongate metal reinforcing beam snugly supported within and extending lengthwise along said channel for reinforcing the free edge of said shelf part.

16. A shelf arrangement according to claim 15, wherein said shelf part and said nose part are defined by a monolithic one-piece member formed of an extrudable material.

* * * * *